United States Patent [19]

Hansen

[11] 4,132,080

[45] Jan. 2, 1979

[54] RESIN ANCHORED ROCK OR MINE ROOF BOLT ANCHOR MECHANISM

[75] Inventor: Roger M. Hansen, Birmingham, Ala.

[73] Assignee: Stratabolt Corporation, Pelham, Ala.

[21] Appl. No.: 849,634

[22] Filed: Nov. 7, 1977

[51] Int. Cl.[2] ..... E21D 21/02

[52] U.S. Cl. ..... 405/261; 85/62

[58] Field of Search ..... 61/45 B; 85/1 L, 32 V, 85/62; 151/21 B, 22; 52/704

[56] References Cited

U.S. PATENT DOCUMENTS

| | | | |
|---|---|---|---|
| 3,683,989 | 8/1972 | Follstaedt | 151/21 B |
| 3,877,235 | 4/1975 | Hill | 61/45 B |
| 4,051,683 | 10/1977 | Koval | 61/45 B |

FOREIGN PATENT DOCUMENTS

| | | | |
|---|---|---|---|
| 566098 | 4/1958 | Belgium | 61/45 B |

*Primary Examiner*—Mervin Stein

*Assistant Examiner*—David H. Corbin

*Attorney, Agent, or Firm*—Mason, Fenwick & Lawrence

[57] ABSTRACT

A resin anchored rock or mine roof bolt anchor assembly including an elongated cylindrical anchor member to be inserted in a bore hole in assembled relation with a bolt after insertion of a destructible adhesive-resin-containing cartridge. The anchor member has an elongated bore to receive threaded portions of the bolt and includes a threaded entrance throat having distorted thread portions providing controlled interference with the threads of the bolt to induce resistance to rotation of the bolt relative to the anchor member when the bolt and throat threads are assembled at a first relative axial position and operative when the anchor member is restrained against rotation in the bore hole by setting of the adhesive resin and torque above a selected threshold is applied to the bolt to accommodate further threaded insertion of the bolt into the anchor member bore.

10 Claims, 4 Drawing Figures

RESIN ANCHORED ROCK OR MINE ROOF BOLT ANCHOR MECHANISM

BACKGROUND AND OBJECTS OF THE INVENTION

The present invention relates in general to pull-up bolting assemblies used as mine roof or rock bolt anchoring mechanisms, and more particularly to mine roof or rock bolt anchor mechanisms of the resin anchored type adapted to be introduced into a bore hole and having a leading end portion adapted to be anchored in the bore hole by a quick setting adhesive after which rotation of the threaded bolt portion draws the bolt portion upwardly to achieve compression force in the rock mass.

In the past, two principal approaches have been used in providing anchor bolts for strengthening roofs in a coal mine, a subway tunnel or similar subterranean structures or to strengthen a rock mass. One type of construction employed parts that are expanded upon insertion within a drill or bore hole to provide a mechanical type of expansion gripping action, permitting a bolt or screw to be tightened upwardly against a face of the rock structure to achieve strengthening of the rock mass. The bolting assembly was required to enable a tension pull-up or tightening down of the bolt and bearing plate assembly in compliance with Bureau of Mines Standards established for the industry, including requirements that such an anchor bolt unit be capable of achieving installed bolt tensions within the range of at least 6,000 to 8,000 pounds.

A more recent type of assembly involves the use of adhesive or grouting material within the bore hole or drill hole for securing the rod or bolt in place, and if pull-up tensioning was required, the outer end of the rod or bolt was threaded and provided with a nut and faceplate washer, permitting the plate to be pulled up against the front face of the rock mass or mine roof when the nut was tightened.

The mechanical type of anchor bolt described above has been somewhat limited in regard to the conditions under which it an be used, as it requires a relatively strong or more stable type of stratum and has not proven satisfactory for many types of formations encountered, particularly where mudstone or siltstone, limestone and laminated sandstone or shale formations occur. The second or adhesive type of anchor bolt unit has the advantage that the adhesive may be employed to strengthen the particular rock formation as well as secure the bolt in position in the bore hole, but such an adhesive type unit has been rather expensive and has required great amounts of adhesive when applied in accordance with the customary practice of substantially filling the hole about the full length of the rod or bolt member.

There has been a general recognition of the need for improved types of bolting assemblies which will make possible the achievement of greater amounts of face compression and draw up tension strength, and which will also reduce expense from the standpoint of installation time and labor and materials.

In an effort to provide a bolting unit of the resin type which would achieve improved compression strength and draw up tension strength, and seek to reduce expense of material and labor and time involved in installation, a type of resin anchored bolt assembly has been proposed in earlier U.S. Pat. No. 3,877,235 wherein a threaded anchor unit was provided with a hollow cylindrical leading portion resembling a pipe-like shell, which was assembled to an anchor bolt and provided with a restraining device that permitted the threaded leading end cylindrical anchor portion to rotate with the anchor bolt, without relative rotation between them, whereby the shell-like anchor portion may be inserted into the bore hole behind a capsule or cartridge of adhesive resin and employed to crush and mix the resin, whereby, when the resin has cured to adhesively secure the anchor portion in the bore hole, application of a predetermined amount of torque to the bolt cause the restraining device to release the bolt for rotation relative to the anchor device and tighten it to generate compressive force in the rock mass. This was achieved by providing a fracturable disc member forming a bottom wall of the pipe-like hollow cylindrical anchor portion to which a standard nut was welded, so that when the anchor portion was held by the resin against further rotation in the bore hole, sufficient torque could be applied to the bolt to fracture and penetrate the frangible disc and allow the bolt upon tightening to be drawn up into the bore hole to produce the desired compressive force effects.

An object of the present invention is the provision of an improved mine roof or rock bolt anchor mechanism of the resin anchored type, wherein the leading end anchor portion of the assembly is readily formed of commercially available material of economic composition of a readily available type, and wherein a nut member with threads deformed or mismatched relative to the threads of the bolt is fixed to the anchor portion and resists rotation of the anchor portion relative to the bolt until sufficient restraint of anchor portion rotation by resin cure occurs, whereupon application of torque to the bolt exceeds the prevailing torque of the nut and bolt threads, whereupon the bolt can be drawn up to tightened condition in the rock mass.

Another object of the present invention is the provision of a threaded anchor and bolt assembly of the resin anchored type, wherein an anchor portion formed of a generally cylindrical body of readily commercially available material is provided with a hollow bore and a nut having threads so related to threads of the bolt as to form a restraining device having prevailing torque characteristics similar to those of metal lock nuts, arranged to prevent or restrain relative rotation of the anchor portion with respect to the bolt upon rotation of the bolt during insertion and resin mixing phases of installation, and wherein the prevailing torque is exceeded by applied torque after the resin is set and restrains the anchor portion against rotation to allow tightening of the bolt to apply the desired compressive force to the rock mass.

Other objects, advantages and capabilities of the present invention will become apparent from the following detailed description, taken in conjunction with the accompanying drawings illustrating preferred embodiments of the invention.

DETAILED DESCRIPTION OF PREFERRED EMBODIMENTS

Figure 1:
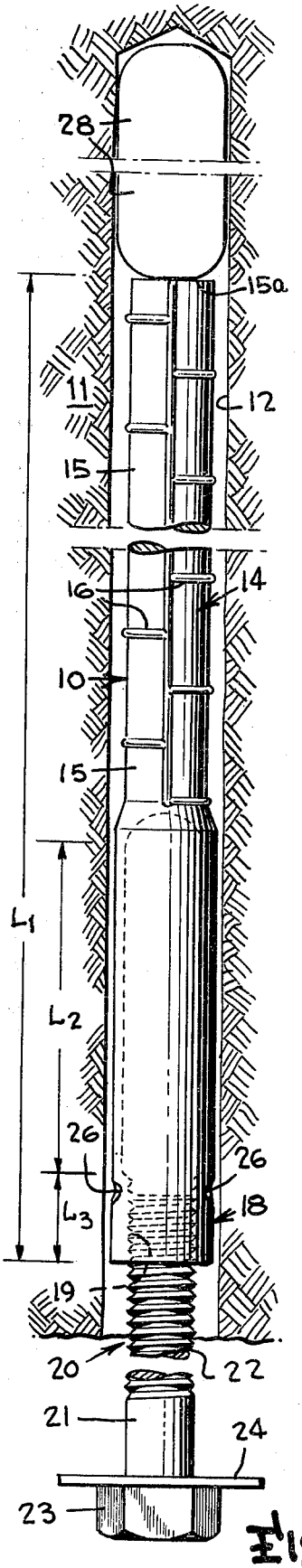
FIG. 1 is a vertical section view in elevation showing the construction of a resin anchored mine roof or rock bolt anchor mechanism constructed in accordance with the present invention, shown inserted into a bore hole in an initial stage of installation before crushing of the resin capsule.

Referring to the drawings, wherein like reference characters designate corresponding parts throughout the several figures, the resin anchored type mine roof or rock bolt anchor assembly or mechanism of the present invention is indicated generally by the reference character 10, and is illustrated in FIG. 1 in the first stage of insertion into a bore hole formed in a mine roof ceiling or rock formation 11. The bore hole 12 is conventionally formed by drilling into the mine roof or rock formation, usually to depths of about 2 to 5 feet, but in some cases, to as much as 10 to 12 feet. The anchoring assembly may be generally described as an upper hollow pipe or shell cylindrical anchor member, indicated by the reference character 14, which may be an inexpensive piece of hollow material such as ordinary steel pipe, but in the preferred embodiment herein illustrated, is formed of a length of conventional surface deformed steel reinforcing rod 15 for reinforced concrete construction and the like, having the surface deformations 16 thereon conforming to usual patterns. The section of reinforcing rod is pierced, hollowed or bored at its lower end to provide a bore 17 along a portion $L_2$ of the total length $L_1$ of the anchor rod member 14. In the illustrated embodiment, the lower end portion of the anchor rod member 14 containing the downwardly opening hollow bore 17 is of slightly larger diameter than the remaining portion of the anchor rod member and the lower end portion of the bore 17 is of slightly smaller internal diameter than the portion of the bore 17 thereabove providing a threaded neck or entrance portion 18 having threads 19 formed along a length $L_3$.

Figure 2:
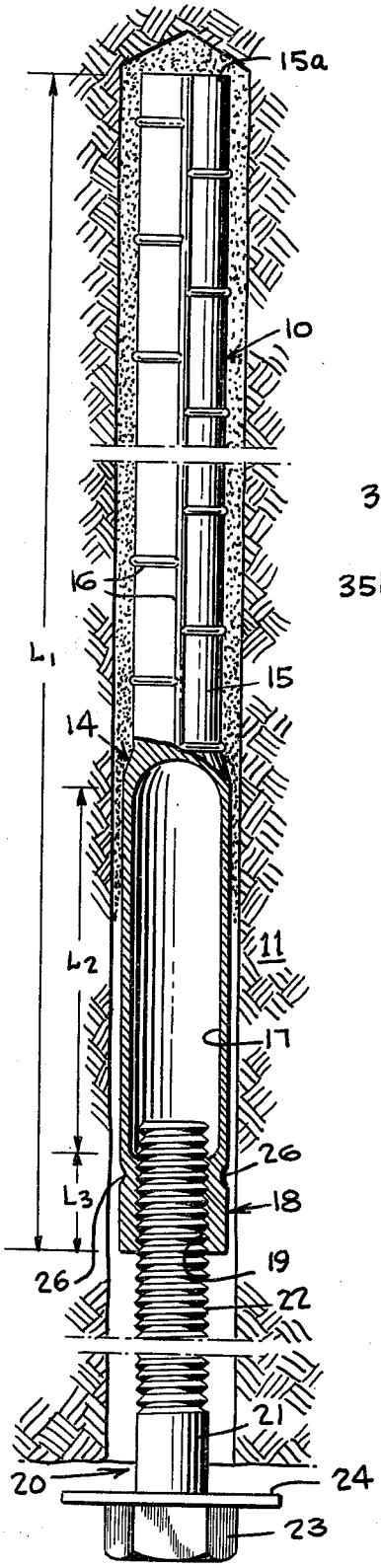
FIG. 2 is a vertical section view similar to FIG. 1, but showing the anchor portion of the resin anchored type anchoring assembly fully inserted in the bore hole after mixing and distribution of the resin and setting of the resin, with portions of the anchor mechanism shown in section.

The threaded neck or entrance portion 18 of the anchor rod member 14 is designed to receive the threaded upper end portion of the tension or anchor bolt 20 having an elongated shank 21 of desired length provided with male threads 22 extending for a predetermined distance along the upper end portion of the shank 21, and having an enlarged head 23 at its lower end which may bear against a bearing plate, such as the plate 24, which in turn, supports the mine roof or the lower surface of the rock formation. Alternatively, the head 23 may be formed with an integral bearing plate portion. The female threads 19 of the threaded column or entrance portion 18 of the anchor rod member 14 are of appropriate pitch to receive and mate with the threads 22 on the upper end portion of the bolt 20, and, in the embodiment illustrated in FIGS. 1 and 2, the female threads 19 are deformed to a non-round condition by one or more indentations indicated at 26, to provide a controlled interference between the male and female threads which induces a resistance to rotation of the bolt relative to the anchor member and thereby result in a prevailing torque thread system.

The resin anchored type anchor bolt assembly above described is designed to be installed by inserting, ahead of the anchor rod member 14 and anchor bolt 20 assembled therewith, an adhesive resin capsule or cartridge, as indicated at 28, containing a quick setting type of resin material of known composition. The amount of adhesive material to be inserted in the bore hole is proportioned to an amount sufficient to fill the space between the innermost or uppermost end of the bore hole and the lower end of, or near the lower end of, the anchor rod member 14 so as to fully extend along the axial length $L_1$ of the anchor rod member 14 in the bore hole.

Typically, the bore hole 12 is drilled into the rock-like structure in the mine roof or ceiling, or rock formation to be stabilized, to a depth to accommodate the length of the adhesive resin capsule, cartridge or sausage 28 to be used, and to accommodate the full length of the cylindrical anchor member 14 and a predetermined portion of the length of the bolt 20. It will be understood that the depth of the bore hole is such that when the resin capsule has been crushed and the cylindrical anchor member 14 is inserted up to fully imbedded position surrounded by the resin mix, the head 23 of the bolt should lie somewhat closer to the face of the rock formation than the axial length $L_2$ of the bore 17 determining the range of axial movement of the bolt permitted by the bore 17. The depth of the bore hole, of course, varies depending upon the type of rock strata which is being strengthened, and the cylindrical anchor member 14 can be readily made to sizes appropriate for the various bore hole depths by simply specifying different lengths or cutting the upper end portion thereof opposite the end having the bore 17 and threads 18.

The adhesive resin capsule or cartridge 28 typically contains a main body of the resin material and a segregated supplemental body of a catalyst, curing, or hardening resin, for example by providing them in a thin-walled resin bag that is easily ruptured or broken by the rotative advance or the forward or upward end **15*a* of the reinforcing rod anchor member 14, when the assembly of the anchor member 14 and assembled bolt 20 restrained against relative movement by the controlled interference of the threads produced by the indentations or deformations 26. After the assembled anchor member 14 and bolt 20 are positioned in the bore hole and have ruptured the cartridge, and the resin material which flows around and surrounds the upper portion of the anchor member 14 filling the space outwardly surrounding the latter, further rotation of the bolt 20 with a torque exceeding the restraining force of the set or cured resin adhesive material after the latter has cured overcomes the prevailing torque conditions established by the deformed thread portions and permits the bolt to then be advanced toward the upper end of the anchor member 14 through the bore 17** until the head and bearing plate portions are drawn tightly against the face of the rock formation.

In accordance with conventional practice in using lock nuts incorporating the prevailing torque principle as a restraint against loosening of the lock nut system, the interference threads are protected against galling, welding or seizing between the threads of the anchor member 14 and the threads 22 of the bolt 20 by applying the same type of lubricant materials used for lock nuts. Use of this lubrication and close control of the manufacturing process enables me to provide a constant prevailing torque and improving torque-tension relationship so that there is less variation in the tension generated upon tightening the bolt than with other types of resin anchor systems.

Figure 3:
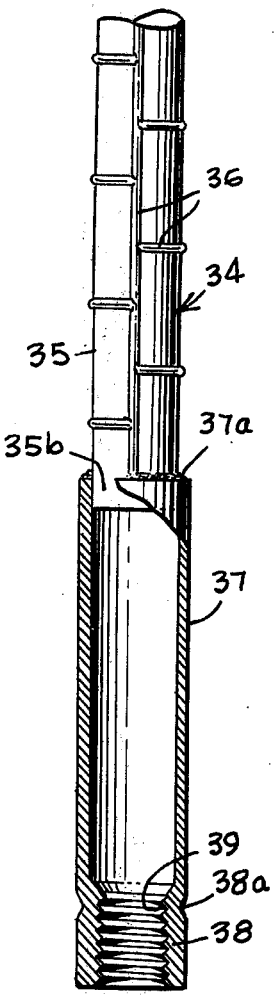
FIG. 3 is a fragmentary section view in elevation of a modified form of resin anchored type anchoring mechanism embodying the present invention.

An alternative arrangement is illustrated in FIG. 3, wherein the cylindrical anchor member, here indicated by the reference character 34, is also formed of a length of conventional surface deformed steel reinforcing rod 35 having the usual surface deformations 36, but wherein a sleeve 37 in the form of a hollow tubular pipe section is attached to the lower end portion 35*b* of the reinforcing rod section by welding, as indicated at 37*a*, and the lower end portion of the sleeve 37 is provided with a threaded neck of entrance portion 38 designed to receive the upper end portion of the tension of anchor bolt 20, having threads 39 deformed by one or more indentations or similar deformations, indicated at 38*a* providing a controlled interference between the male and female threads which induces resistance to rotation of the bolt relative to the anchor to result in a prevailing torque thread system in the same manner as the first described embodiment.

Figure 4:
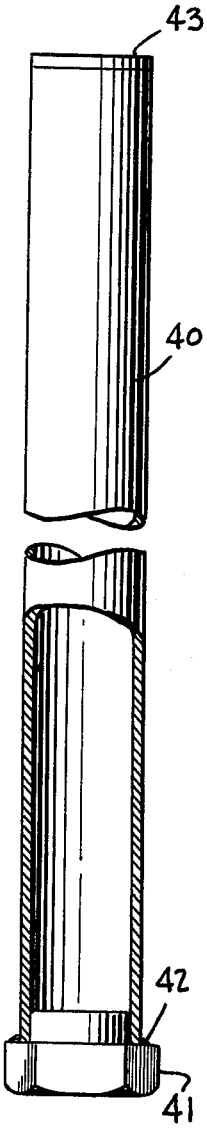
FIG. 4 is a section view of another modified form of the resin anchored type mine roof bolting mechanism.

A third configuration is illustrated in FIG. 4, wherein a tube or pipe member 40 forms the cylindrical anchor bolt and is welded to an all-metal lock nut of conventional design, indicated at 41, by welding indicated at 42. The top end of the tubular pipe section 40 has a cap or solid cylindrical disc 43 welded thereto to close the upper end and operate in the same manner as the two previously described embodiments.

What is claimed is:

1. A rock and mine roof anchor and bolt assembly of the resin anchored type to be mounted in a bore hole in a mine roof rock formation or the like for strengthening the same, comprising an elongated anchor member of generally cylindrical configuration having a shorter length than the depth of the bore hole in which it is to be fitted and having an uninterrupted upper end surface and a lower permanently interconnected end portion, the anchor member having an elongated axial bore in at least the lower end portion thereof and a constricted diameter threaded entrance throat having female threads and opening through the lower end portion, a bolt having a threaded stem portion having male threads threaded into the female threads of said anchor member and having an enlarged head portion and bearing plate means to be drawn tightly against the face of the rock formation, the anchor member being adapted to be introduced into the bore hole in assembled relation with the bolt after insertion of a destructible cartridge containing quick-setting adhesive resin therein to crush the cartridge and mix and distribute the adhesive material throughout the space outwardly surrounding most of the anchor member and adhesively fixing the anchor member in the bore hole upon hardening of the adhesive material thereabout, said female threads including distorted thread portions providing controlled interference between said female and male threads inducing resistance to rotation of the bolt relative to the anchor member and thereby form a controlled torque thread zone with the threads of the bolt, the bolt being initially assembled in threaded relation with the threaded throat of the anchor member to a position wherein the distorted thread portions of the female threads exert a predetermined restraint to relative rotation of the bolt with respect to the anchor member until a predetermined threshold controlled torque force is exceeded, and said distorted thread portions accommodating further threaded insertion of the bolt into the bore of the anchor member when the anchor member is restrained against rotation by setting of the adhesive resin and torque in excess of the predetermined threshold amount is applied to the bolt.

2. A rock and mine roof anchor and bolt assembly of the resin anchored type as defined in claim 1, wherein said controlled torque thread zone is formed by providing one or more indentations in the exterior of the anchor member outwardly encircling said entrance throat deforming the female threads along regions thereof to distort them to a nonround configuration providing the interference between the female and male threads.

3. A rock and mine roof anchor and bolt assembly of the resin anchored type, as defined in claim 1, wherein said anchor member is an elongated, generally cylindrical section of steel reinforcing rod of the type used for reinforced concrete construction and the like having conventional longitudinal and transverse protruding surface deformations along the exterior surface thereof, the reinforcing rod having said bore and entrance throat formed in the end of the reinforcing rod section forming the lower end portion of the anchor member, and the female threads in the threaded entrance throat portion being deformed along a limited region thereof to provide the interference between the female and male threads providing the controlled torque thread zone.

4. A rock and mine roof anchor and bolt assembly of the resin anchored type as defined in claim 2, wherein said anchor member is an elongated, generally cylindrical section of steel reinforcing rod of the type used for reinforced concrete construction and the like having conventional longitudinal and transverse protruding surface deformations along the exterior surface thereof, the reinforcing rod having said bore and entrance throat formed in the end of the reinforcing rod section forming the lower end portion of the anchor member, and the female threads in the threaded entrance throat portion being deformed along a limited region thereof to provide the interference between the female and male threads providing the controlled torque thread zone.

5. A rock and mine roof anchor and bolt assembly of the resin anchored type as defined in claim 1, wherein the portion of said anchor member outwardly surrounding the said axial bore in the lower end portion thereof has a larger diameter than the portions of the anchor member extending thereabove to restrict the space in the bore hole outwardly surrounding the lower end portion of the anchor member and resist flow of the adhesive below the anchor member.

6. A rock and mine roof anchor and bolt assembly of the resin anchored type as defined in claim 3, wherein the lower portion of said reinforcing rod section outwardly surrounding the said axial bore in the lower end portion thereof has a larger diameter than the portions of the anchor member extending thereabove to restrict the space in the bore hole outwardly surrounding the lower end portion of the anchor member and resist flow of the adhesive below the anchor member.

7. A rock and mine roof anchor and bolt assembly of the resin anchored type as defined in claim 4, wherein the lower portion of said reinforcing rod section outwardly surrounding the said axial bore in the lower end portion thereof has a larger diameter than the portions of the anchor member extending thereabove to restrict the space in the bore hole outwardly surrounding the lower end portion of the anchor member and resist flow of the adhesive below the anchor member.

8. A rock and mine roof anchor and bolt assembly of the resin anchored type as defined in claim 1, wherein the portion of said anchor member extending from immediately above said axial bore to the upper end surface thereof is formed of a section of conventional surface deformed steel reinforcing rod of the type conventionally used in reinforced concrete construction having longitudinal and transverse outwardly projecting rib formations thereon, and the portions of the anchor member containing said axial bore and threaded entrance throat is formed of an initially separate tubular sleeve member welded at its upper end to the lowermost end of said section of steel reinforcing rod and having the threaded entrance throat of constricted diameter formed in the end thereof opposite to the end welded to the reinforcing rod.

9. A rock and mine roof anchor and bolt assembly of the resin anchored type as defined in claim 8, wherein said controlled torque thread zone is formed by providing one or more indentations in the exterior of the anchor member outwardly encircling said entrance throat deforming the female threads along regions thereof to distort them to a nonround configuration providing the interference between the female and male threads 10. A rock and mine roof anchor and bolt assembly of the resin anchored type as defined in claim 1, wherein said anchor member is formed of an elongated hollow pipe member having said bore extending along the length of the pipe member and having a solid cylindrical disc welded to the upper end thereof forming an upper end closure, and a metal lock nut having a threaded opening of smaller diameter than the hollow bore of the pipe section welded to the lower end of the pipe section and having controlled torque forming threads providing controlled interference between the lock nut threads and the male threads of the bolt.

* * * * *